US005170703A

United States Patent [19]

Tu et al.

[11] Patent Number: 5,170,703

[45] Date of Patent: Dec. 15, 1992

[54] MACHINE FOR SCREEN PRINTING CURVED OBJECTS

[76] Inventors: Ming T. Tu, 7th Fl., No. 96, Jenai 1st St., Kaohsiung; Sheng L. Chung, No. 15, Hsi Pu, Hsi Pu Village, Nan Hwa Hsiang, Tainan Hsien, both of Taiwan

[21] Appl. No.: 828,126

[22] Filed: Jan. 30, 1992

[51] Int. Cl.[5] ..... B41F 15/30; B41F 17/30

[52] U.S. Cl. ..... 101/39; 101/123

[58] Field of Search ..... 101/39, 38.1, 40, 40.1, 101/123, 124, 126

[56] References Cited

U.S. PATENT DOCUMENTS 4,352,326 10/1982 Kammann ..... 101/39 X

*Primary Examiner*—Clifford D. Crowder

*Attorney, Agent, or Firm*—Bacon & Thomas

[57] ABSTRACT

A machine for screen printing curved objects has a frame with support rods and positioning rods, a scraping assembly which slides on the support rods under the influence of a motor and a gear wheel/spur rail combination, and a pair of screen-holding structures which are anchored to the positioning rods and hold a screen therebetween. The scraping assembly and the screen-holding assembly can be vertically positioned under the influence of pneumatic cylinders. A workpiece mold holds a curved workpiece such as a bowl and is rotatable under the influence of an axle and another gear wheel/spur rail combination. Three scrapers are attached to the scraping assembly. When the motor is activated, the scraping assembly moves and the workpiece mold rotates. Outside scrapers spread ink on the screen and a center scraper applies the ink to the workpiece. A proximity switch stops the motor when the scraping assembly has moved a predetermined distance. The machine preferably has two sets of scraping assemblies and two pairs of screen-holding structures.

9 Claims, 7 Drawing Sheets

MACHINE FOR SCREEN PRINTING CURVED OBJECTS

BACKGROUND OF THE INVENTION

The present invention relates to a screen printing machine and, more particularly, to a machine that is able to screen print curved or cylindrical objects.

With reference to FIG. 7, a conventional machine for screen printing curved objects generally comprises a first pneumatic cylinder 10, a scraper means 20, a screen holder 30, and a second pneumatic cylinder 40. The first pneumatic cylinder 10 actuates the scraper means 20 to move. The scraper means 20 comprises a pair of scrapers which are drawn over a screen held by the screen holder 30. The second pneumatic cylinder 40 cooperates with a workpiece mold to secure a workpiece in place. The workpiece has a curved surface.

During operation, a screen held by the screen holder 30 is placed against a workpiece held by the workpiece mold and the second pneumatic cylinder 40. The scrapers of the scraper means 20 are drawn across the surface of the screen, pressing ink onto the workpiece.

A disadvantage of this conventional design is the low production capacity as only one workpiece per stroke can be screen printed. Another disadvantage is the low quality of the print as the workpiece does not rotate which limits the amount of curved surface which can be printed. Also, the conventional machine occupies a large amount of space for the work capacity it can accomplish.

Therefore, there exists a need in the field of screen printing machines for a machine which is able to print on the entire curved surface of a workpiece, which can screen print more than one workpiece at a time, and which does not occupy a relatively large amount of floor space.

SUMMARY OF THE INVENTION

The present invention provides an apparatus which is able to screen print two curved workpieces at a time. A frame vertically supports a scraping means with a pair of scraping assemblies on support rods thereof and horizontally supports two pairs of screen-holding means on positioning rods thereof. The scraping assemblies are vertically positionable on support means thereof, and the screen-holding means are horizontally positionable on the positioning rods.

Each scraping means has a trio of scraper shelves to which a trio of scrapers are respectively attached. A trio of pneumatic cylinders respectively actuate the scraper shelves for vertical movement thereof. Each screen-holding means has a fixing shelf in which a securing shelf is vertically moveable under the influence of a pneumatic cylinder. A screen is fixed between respective screen-holding means by the securing shelves.

A pair of substantially disc-shaped workpiece-holding means for retaining a curved workpiece apiece such as a bowl and a rotation means for providing rotation to the workpiece-holding means are disposed on the scraping means. The rotation means has an axle retained by the scraping means to which the workpiece-holding means are attached to respective ends thereof. A gear wheel is fixed to an intermediate portion of the axle and meshes with a horizontally-disposed spur rail.

A motor and a translation means are further disposed on the scraping means. A gear wheel in direct communication with the motor meshes with another horizontally-disposed spur rail. Sensing means such as proximity switches are disposed to the frame and are in communication with the motor for sensing the position of the scraping means.

In operation, workpieces are respectively mounted to the workpiece-holding means, being held thereon by frictional forces therebetween. Screens are respectively mounted between respective pairs of screen-holding means, being held thereon by suitable fastening means on the securing shelves. The pneumatic cylinders of the screen-holding means then draw the screens down to respectively contact the outer circumferential peripheries of the workpieces. The pneumatic cylinders of the scraping assemblies then extend a center scraper shelf and a leading-edge scraper shelf down to respectively contact the screens.

After a suitable ink is applied to the screens in a conventional manner, the motor is activated and rotates the gear wheel communicating therewith. Both gear wheels mesh with respective spur rails to respectively horizontally move the scraping assembly and rotate the workpiece-holding means. The leading-edge scrapers spread the ink over the screens and the center scrapers applies the ink to the circumferential peripheries of the workpieces.

As the scraping means nears the proximity switch, the latter stops the motor. The above process is then reversed accordingly for new workpieces in the opposite direction.

It can be seen that the present apparatus for screen printing curved objects affords assemblies for screen printing two workpieces at a time and prints in two directions. It can be realized that the quality of the printing process is increased by the rotation of the workpieces and the disposition of the trio of scrapers. The apparatus is easily manipulated to accommodate different size screens and workpieces.

Accordingly, it is a primary object of the present invention to provide an apparatus for screen printing curved objects which increases productivity and quality.

It is another object of the present invention to provide an apparatus for screen printing curved objects which prints two objects at a time.

It is still another object of the present invention to provide an apparatus for screen printing curved objects which prints objects in two directions.

It is yet another object of the present invention to provide an apparatus for screen printing curved objects which stops the printing after a predetermined distance.

It is a still further object of the present invention to provide an apparatus for screen printing curved objects which accommodates various sizes of screens and workpieces.

These and additional objects will become apparent to a person skilled in the art upon reading the following detailed description with reference to the accompanying drawings.

DETAILED DESCRIPTION OF THE PREFERRED EMBODIMENTS

CONSTRUCTION

Figure 1:
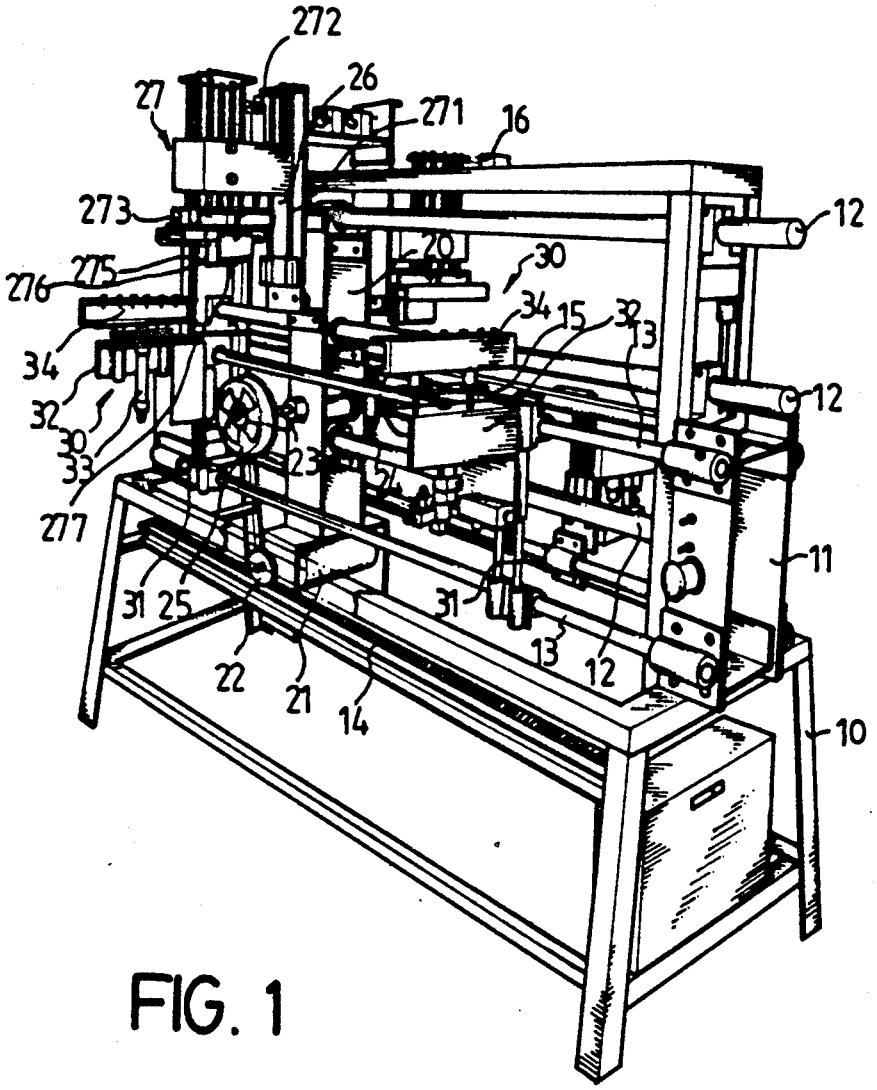
FIG. 1 is a perspective view of a machine for screen printing curved objects in accordance with the present invention.
Figure 2:
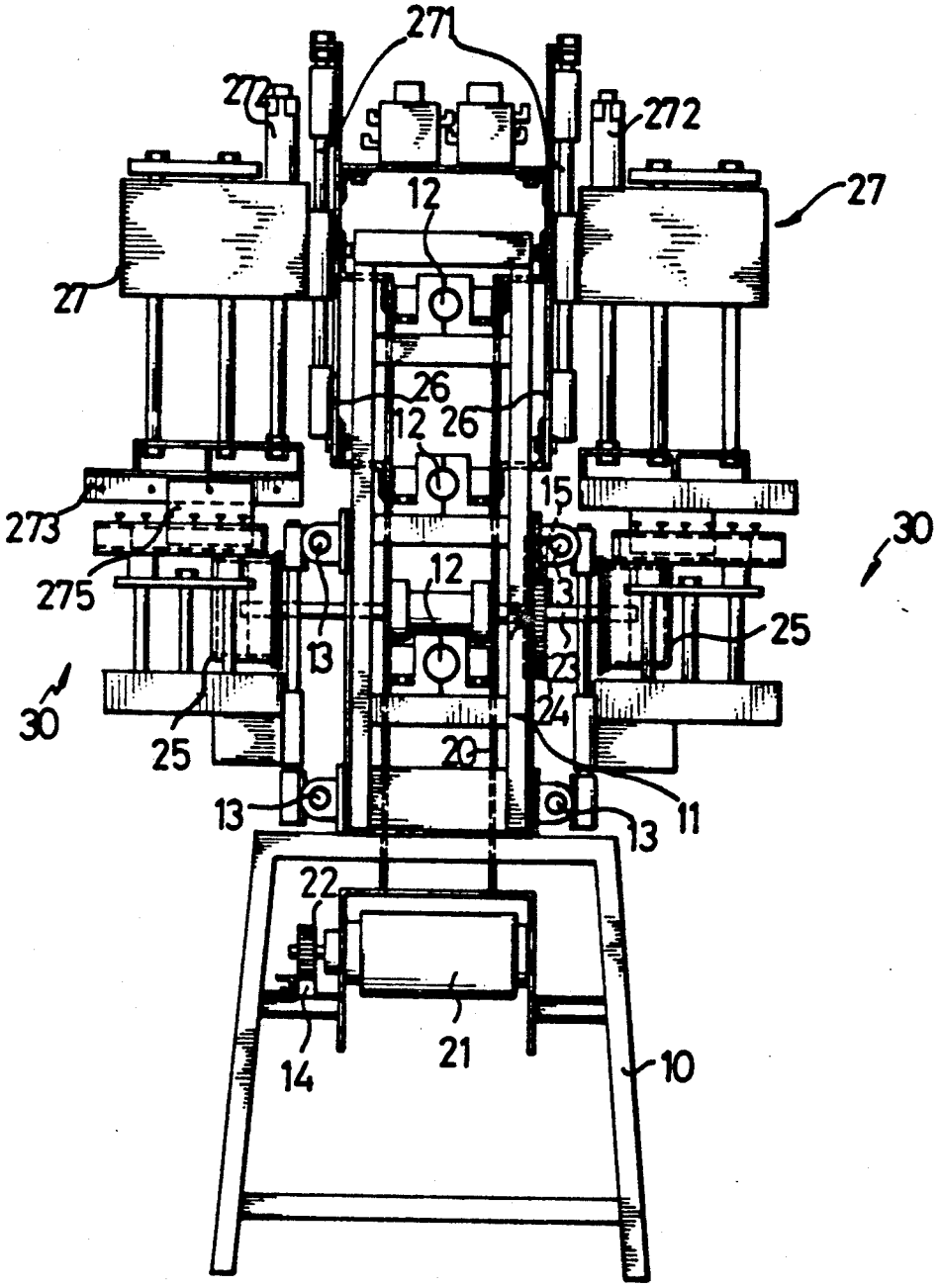
FIG. 2 is a front plan view of the machine for screen printing curved objects.
Figure 3:
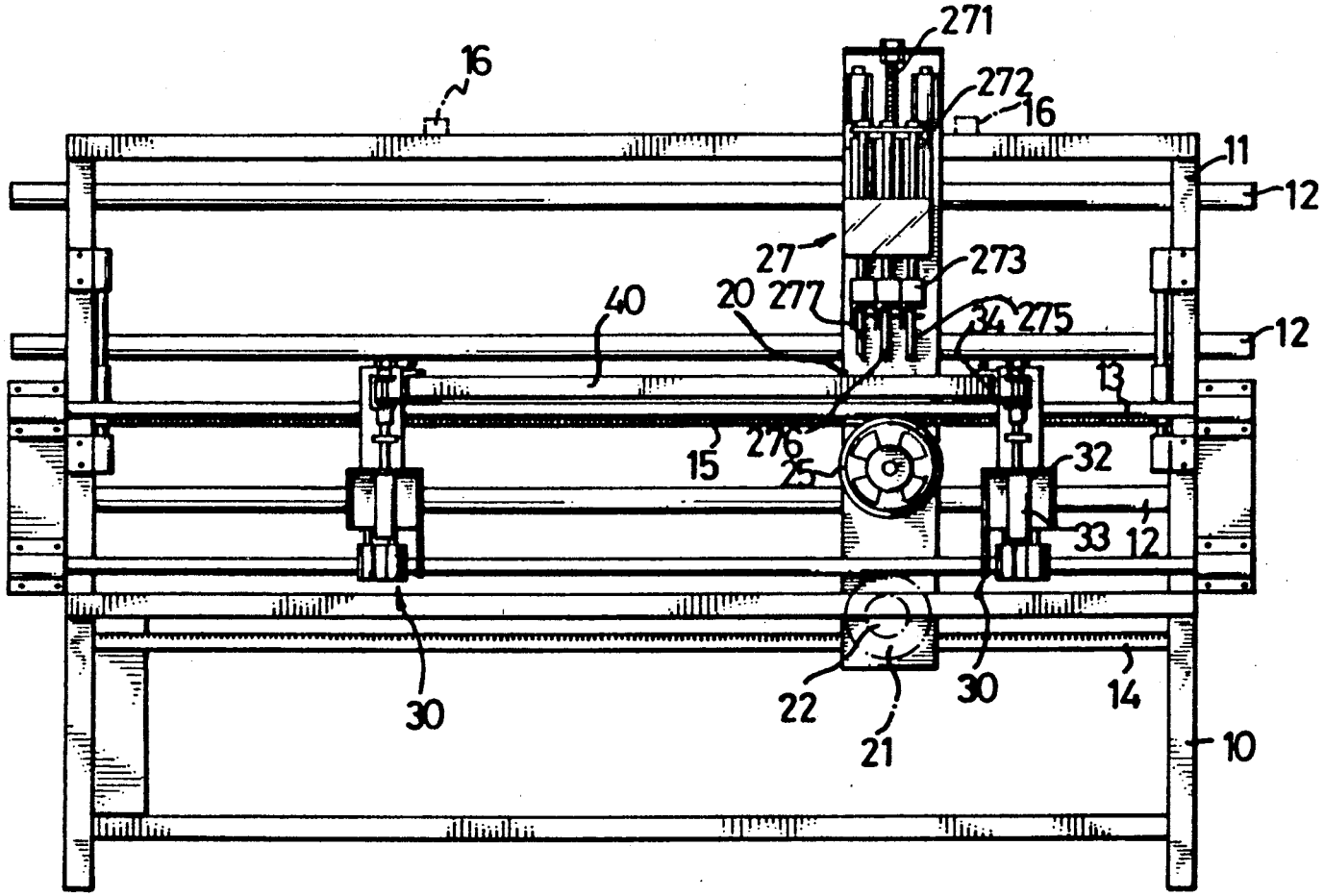
FIG. 3 is a side plan view of the machine for screen printing curved objects, showing screen-holding means with a screen in an upper position.

Referring to the drawings, initially to FIGS. 1 to 3, a machine for screen printing curved or cylindrical objects is shown and generally comprises a frame 10, a scraping means 20, and two pairs of screen-holding means 30. In conjunction with the frame 10, a number of vertical supporting plates, such as those indicated by reference numeral 11, provide support for horizontally-disposed support rods 12 and positioning rods 13, as well as for a lower spur rail 14 and an upper spur rail 15 also disposed horizontally. Sensing means such as a pair of proximity switches 16 are provided on a top of the frame 10.

The scraping means 20 generally comprises a vertically-disposed body portion which is slidably mounted on the support rods 12; a motor 21 which is in communication with the proximity switches 16 and is supported by the body portion; a translation means such as a first gear wheel 22 which is in direct communication with the motor 21 and meshes with the lower spur rail 14; a rotation means including an axle 23 which is retained by the body portion and a second gear wheel 24 which meshes with the upper spur rail 15 and is attached to the axle 23; a pair of substantially disc-shaped workpiece-holding means 25 each of which holds a workpiece thereon and is attached to a respective end of the axle 23; a pair of vertically-disposed support plates 26 each of which is attached to the body portion; and a pair of scraper assemblies 27 each of which is attached to and positionable on the support plates 26.

Each scraping assembly 27 generally comprises a body portion which is vertically positionable on at least a pair of vertically-disposed support rods 271 which are attached in a spaced relationship to the support plate 26; a trio of pneumatic cylinders 272 which are vertically disposed on the body portion thereof; a trio of scraper seats 273 which are vertically and slidably disposed in the body portion thereof and which are respectively actuated by the pneumatic cylinders 272; and a pair of leading-edge scrapers 275 and 277 and a center scraper 276 which are respectively attached to the scraper seats 273.

Each screen-holding means 30 comprises a body portion with an adjusting screw 31 which is positionable and anchorable on the positioning rods 13; a fixing shelf 32 which essentially forms a horizontally-disposed part of the body portion thereof; a pneumatic cylinder 33 which is vertically-disposed on the fixing shelf; and a securing shelf 34 which is slidably disposed in a vertical direction on the fixing shelf 32. FIG. 3 shows the further provision of a framed screen 40 which is placed between respective securing shelves 34 of the screen-holding means 30 and held thereon by fastening means.

OPERATION

With continued reference to FIGS. 1 to 3, in operation a curved workpiece such as a bowl, a cup, a glass, etc. is positioned on each workpiece-holding means 25, being held thereon by frictional forces therebetween. An appropriate screen 40 is secured between the screen-holding means 30.

Figure 4:
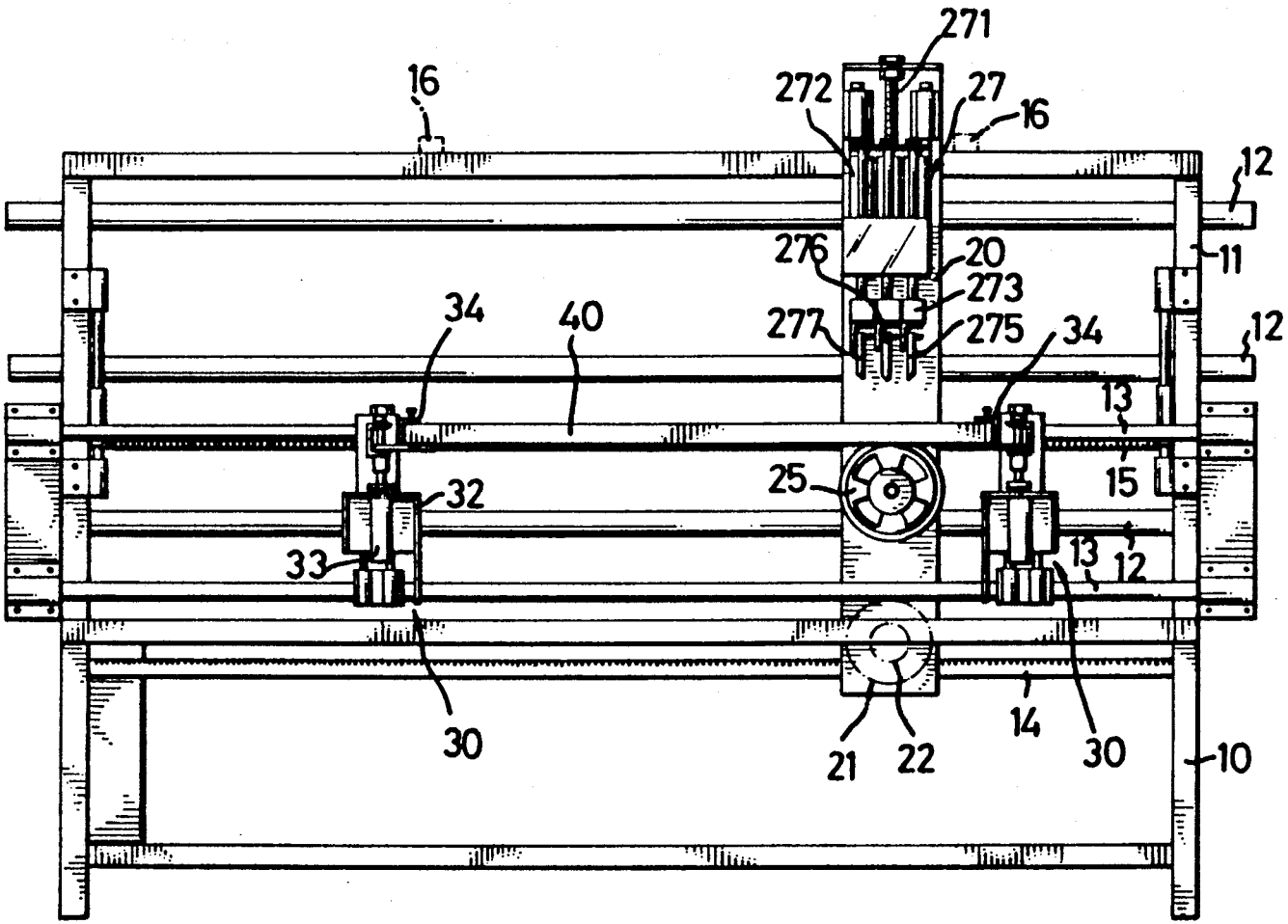
FIG. 4 is a view similar to FIG. 3, showing the screen-holding means with the screen in a lowered position.

With further reference to FIG. 4, the pneumatic cylinders 33 of the screen-holding means 30 retract, thereby drawing the screens 40 down to respectively contact with under surfaces thereof the outer circumferential peripheries of the workpieces.

Figure 5:
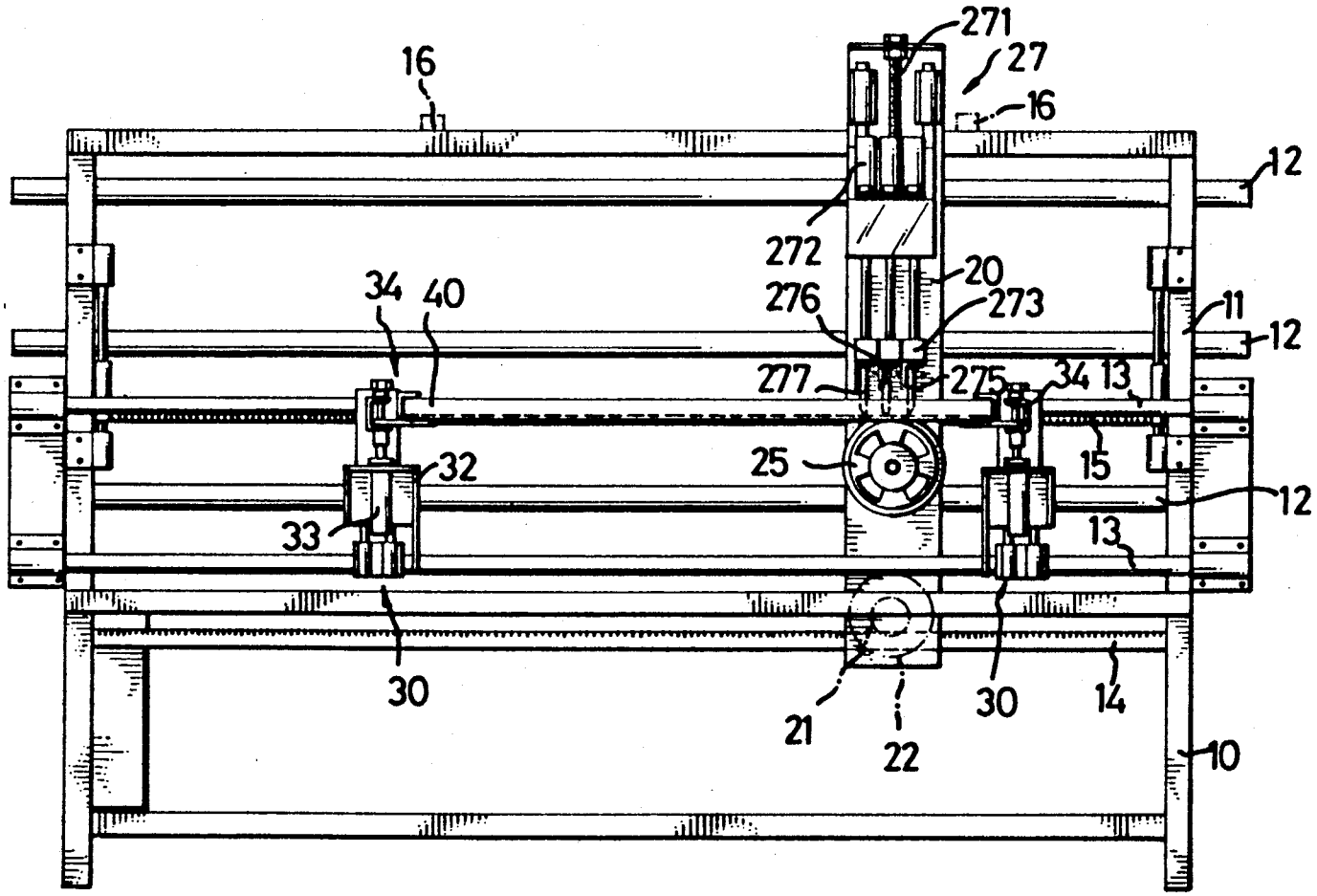
FIG. 5 is a view similar to FIG. 3, showing a scraper assembly in a lowered position.

With still further reference to FIG. 5, the pneumatic cylinders 272 of the scraping means 20 which correspond to scraper shelves of leading-edge scrapers 277 and the center scrapers 276 extend, thereby lowering leading-edge scrapers 277 and the center scrapers 276 down to respectively contact upper surfaces of the screens 40. The center scrapers 276 are positioned directly above the twelve o'clock positions of the workpiece-holding means 25.

After a suitable ink has been applied by conventional means to the screens 40, the motor 21 is actuated, thereby revolving the first gear 22 which meshes with the lower spur rail 14, such that the scraping means 20 is horizontally translated. As the scraping means 20 moves, leading-edge scrapers 277 spread the ink evenly across the upper surfaces of the screens 40 and the center scrapers 276 apply the ink to the workpiece.

Also as the scraping means 20 moves, the second gear wheel 24 meshes with the upper spur rail 15, thereby rotating the axle 23 and the workpiece-holding means 25 and, consequently, the workpieces. Therefore, the circumferential peripheries of the workpieces are screen printed uniformly.

Figure 6:
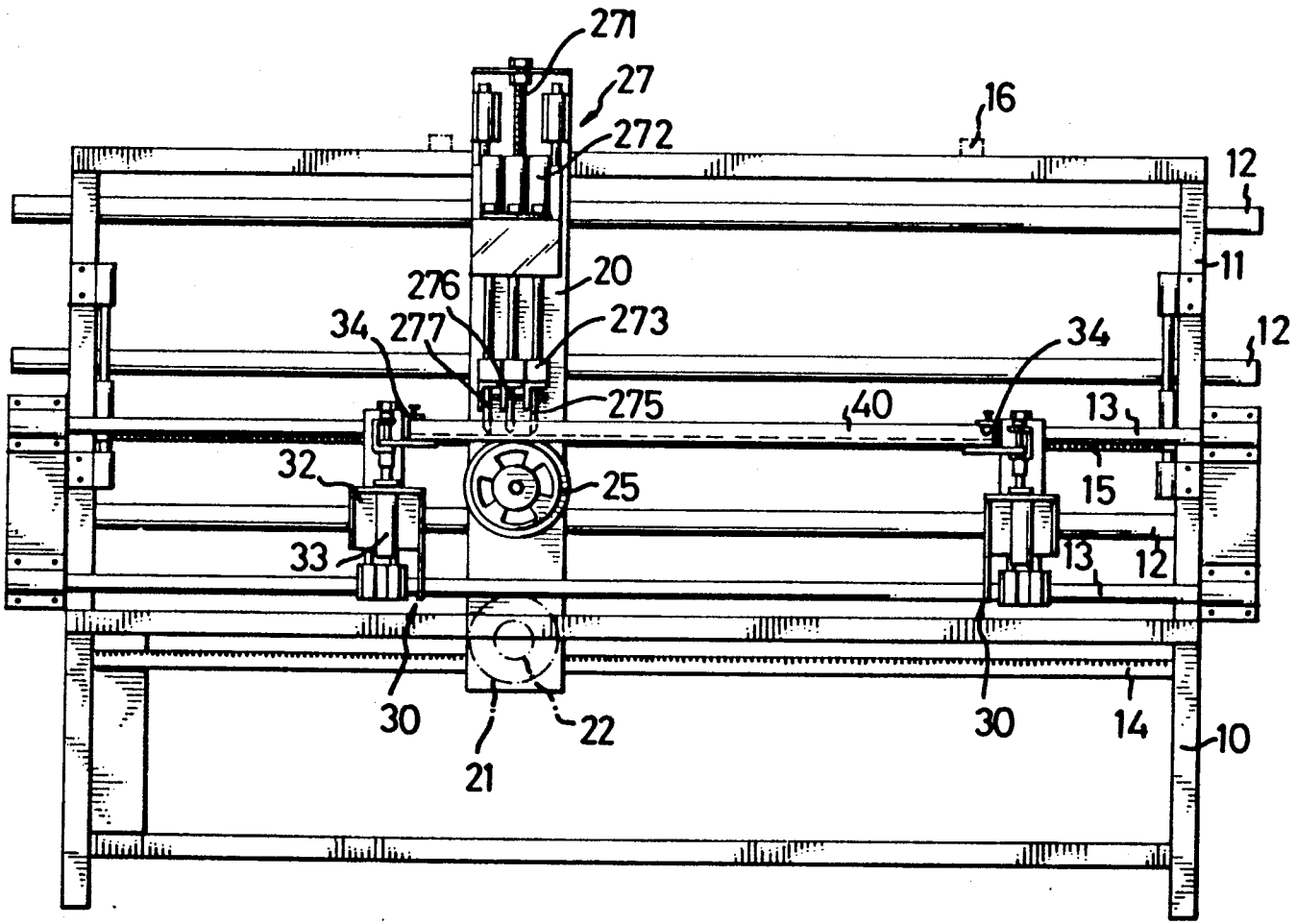
FIG. 6 is a view similar to FIG. 3, showing the scraper assembly at a second end of the machine.
Figure 7:
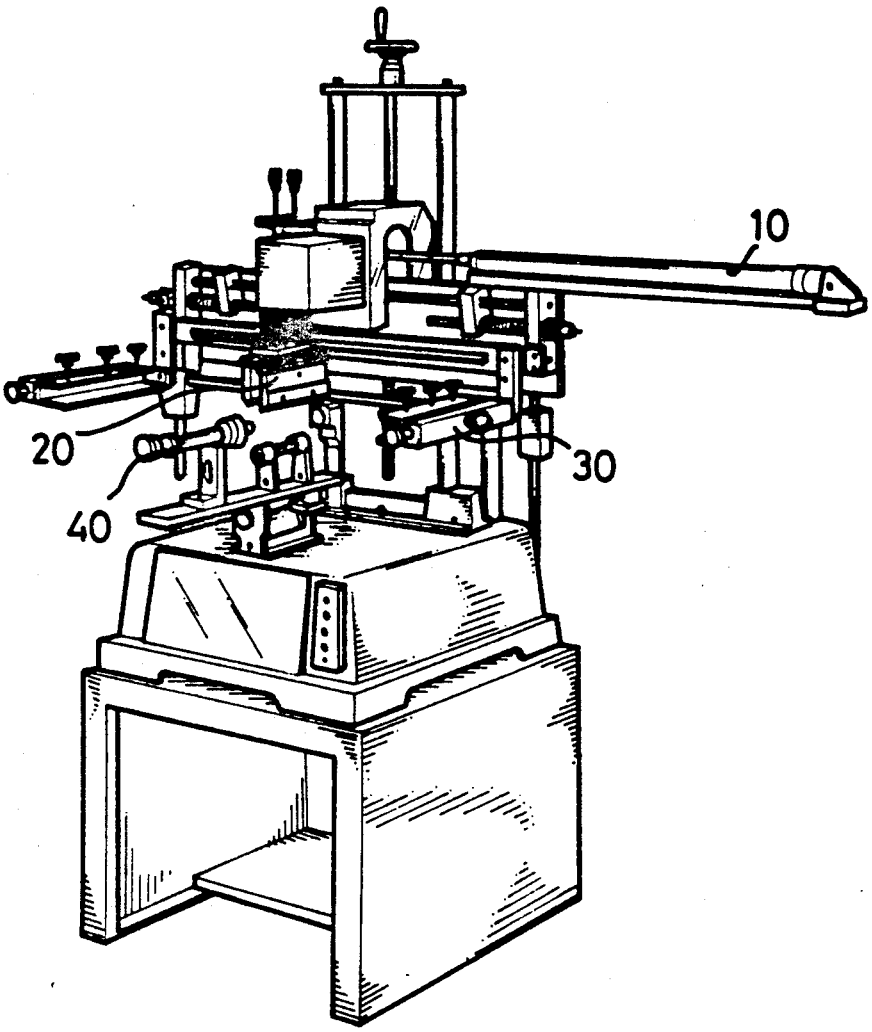
FIG. 7 PRIOR ART
FIG. 7 is a perspective view of a machine for screen printing curved objects according to prior art.

With further reference to FIG. 6, when the scraping means 20 moves within a sensing distance of the proximity switch 16, the motor 21 is deactivated, thereby stopping movement of the scraping means 20. The placement of the proximity switches 16 depends upon the number of patterns on the screens 40 to be printed, the desired number of revolutions of the workpieces, and the circumference of the workpieces themselves.

To remove the printed workpieces from the workpiece-holding means 25, the pneumatic cylinders 272 and 33 respectively retract and extend, thereby raising the scraping seats 273 and the securing shelves 34, such that the workpieces are free for removal.

From the position shown in FIG. 6, another pair of unprinted workpieces may be replaced on the workpiece-holding means 25 or the same workpieces may be retained while a new pair of screens 40 with different patterns is replaced between the securing shelves 34. The above-described operation is then reversed in the opposite direction, with the exception of leading-edge scrapers 275 spreading the ink evenly on the upper surfaces of the screens 40 and the center scrapers 276 applying the ink to the workpiece. The other proximity switch 16 stops the motor 21 when the scraping means 20 moves within the sensing distance, such that the position shown in FIG. 5 is attained once again.

From the above, the following characteristics and variations are apparent. Different sized workpieces may be used with different size workpiece-holding means 25 as the scraping assemblies 27 are vertically positionable on the support rods 271. Different sized screens 40 may also be used as the screen-holding means 30 are positionable on the positioning rails 13. Furthermore (as can be particularly seen in FIG. 2), different sized scrapers 275, 276, and 277 may be mounted to the scraper seats 273 depending upon the sizes of the workpieces and the screens.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. Apparatus for screen printing curved objects comprising:

a frame comprising at least a pair of horizontally-disposed support rods and at least one pair of horizontally-disposed positioning rods attached thereto;

scraping means comprising a first body portion slidably mounted on said support rods, a motor mounted on said first body portion, translation means cooperating with said motor for providing horizontal motion for said first body portion; at least one workpiece-holding means for holding a workpiece to be printed; rotation means being disposed on said first body for rotating said workpiece-holding means as said first portion body portion moves; and at least one scraping assembly; and at least one pair of screen-holding means for holding a printing screen comprising a second body portion positionable and anchorable on said positioning rods, a securing shelf slidably disposed in a vertical direction on said second body portion, and a pneumatic cylinder for actuating said securing shelf;

said scraping assembly comprising a third body portion attached to said first body portion of said scraping means, at least a pair of scraper seats slidably disposed in a vertical direction on said third body portion, a corresponding number of pneumatic cylinders for respectively actuating said scraper seats, and a corresponding number of scrapers respectively attached to said scraper seats;

said workpiece-holding means positioned below the screen held by said screen-holding means;

whereby said scraper seats are lowered such that said scrapers contact an upper surface of the screen and the workpiece held by the workpiece-holding means contacts an under surface of the screen; said motor being actuated and driving said translation means, thereby moving said scraping means; said rotation means rotating said workpiece-holding means, thereby the circumferential periphery of the workpiece is printed.

2. Apparatus as claimed in claim 1, further comprising sensing means for stopping said motor when said scraping means has moved a predetermined distance.

3. Apparatus as claimed in claim 1, wherein said translation means comprises a gear wheel directly communicating with said motor and a spur rail horizontally disposed along a length of said frame, whereby when said motor is actuated, said gear wheel rotates and meshes with said spur rail, thereby moving said scraping means.

4. Apparatus as claimed in claim 1, wherein said workpiece-holding means is substantially disc-shaped and at least one said scraper is directly positioned at a twelve o'clock position of said workpiece-holding means.

5. Apparatus as claimed in claim 4, wherein said rotation means comprises an axle attached to a center of said workpiece-holding means and retained by said first body portion, a gear wheel attached to said axle, and a spur rail horizontally disposed along a length of said frame, whereby when said first body portion moves, said gear wheel meshes with said spur rail and rotates, thereby rotating said axle and said workpiece-holding means.

6. Apparatus as claimed in claim 1, wherein said scraping assembly comprises a trio of said scraper seats, said pneumatic cylinders, and said scrapers; said scrapers being divided into leading-edge scrapers for spreading ink over the screen and a center scraper for applying the ink to the workpiece; said center scraper being positioned in direct contact with the workpiece.

7. Apparatus as claimed in claim 1, wherein said scraping means comprises a pair of scraping assemblies and said workpiece-holding means, said frame comprises two pairs of said positioning rod, and said apparatus comprises two pairs of said screen-holding means.

8. Apparatus as claimed in claim 2, wherein said sensing means comprises a pair of proximity switches disposed on said frame and communicating with said motor.

9. Apparatus as claimed in claim 1, wherein said scraping means further comprises supporting means; said scraping assembly attached to said support means and vertically positionable thereon.

* * * * *